United States Patent [19]

Tarassoff

[11] Patent Number: 4,777,886

[45] Date of Patent: Oct. 18, 1988

[54] APPARATUS FOR SUPPORTING CABLES AND TRANSPORTATION INSTALLATION WITH AERIAL CABLES COMPRISING AN APPARATUS OF THIS TYPE

[75] Inventor: Serge Tarassoff, Seyssinet Pariset, France

[73] Assignee: Pomagalski SA, France

[21] Appl. No.: 940,586

[22] Filed: Dec. 11, 1986

[30] Foreign Application Priority Data

Dec. 11, 1985 [FR] France ..... 85 18333

[51] Int. Cl.[4] ..... B61B 7/00

[52] U.S. Cl. ..... 104/180; 104/197; 104/116

[58] Field of Search ..... 104/112, 115, 116, 173.1, 104/173.2, 180, 182, 197

[56] References Cited

U.S. PATENT DOCUMENTS 347,443 8/1886 Roe et al. ..... 104/180

4,509,430 4/1985 Creissels ..... 104/173.1

*Primary Examiner*—Johnny D. Cherry

*Assistant Examiner*—Frank H. Williams, Jr.

*Attorney, Agent, or Firm*—Fred A. Keire

[57] ABSTRACT

An aerial transportation system including two generally parallel endless aerial carrier and traction cables is disclosed in which apparatus is respectively associated with each of the cables for separately supporting each cable. The supporting apparatus associated with each cable each comprise at least one basic balance beam, at least one roller rotatably mounted at one end of the balance beam for engaging its associated cable and at least one support balance beam with the basic balance beam being pivotally mounted at one end on the support balance beam for pivotal movement about a pivot axis extending at right angles to the cables. A support structure is provided for the balance beams with the support balance beam being pivotally mounted on the support structure. The basic balance beams, rollers and support balance beam associated with each cable are arranged on their respective support structures in facing relation to each other so that the basic balance beams on the respective support structures, and located in facing relation to each other, are mechanically independent of each other. The amplitude of pivoting of the basic balance beams about their respective pivot axis are limited between two predetermined extreme positions.

7 Claims, 1 Drawing Sheet

III
IV
P
1a
1b
Pa
Pb

APPARATUS FOR SUPPORTING CABLES AND TRANSPORTATION INSTALLATION WITH AERIAL CABLES COMPRISING AN APPARATUS OF THIS TYPE

BACKGROUND OF THE INVENTION

The invention relates to an apparatus for supporting cables and a transportation installation with aerial cables comprising an apparatus of this type.

An apparatus for supporting cables intended for a transportation installation having two carrying and pulling aerial cables, comprising a tower, a bracket supported by the tower and balance-beams equipped with rollers over which the cables travel, supported by the bracket, is already known (European Pat. No. 93 680). More precisely, this known apparatus comprises basic balance-beams which, for each cable, comprise a flat bar on which two rollers are mounted, the two flat bars of the two cables being connected rigidly to each other by virtue of a rigid stirrup member. This basic balance-beam constitutes a non-deformable, one-piece arrangement mounted to pivot by its flat bars about a point at right angles to the cables on small girders themselves mounted to pivot. The main structural feature of this known apparatus is that on the one hand the spacing of the rollers corresponding to two cables is kept positively constant and equal to the spacing of the cables and that on the other hand, the pivoting movements of all the rollers (about the pivot point of the flat bars) corresponding to the two cables are carried out positively in perfect synchronism, that is to say that symmetrical pivoting of the balance-beams is imposed. Maintaining the spacing and synchronism positively as well as the symmetry of the pivoting is obtained by virtue of the rigid stirrup member making the rollers (or more precisely their axes of rotation) arranged to correspond and associated with the two cables into a one-piece and non-deformable arrangement. Taking into account the passage which has to be left free between the cables for the carriage or the like supporting the vehicle, the stirrup member is in the general shape of an inverted U. This known structure responds to the necessity of ensuring perfect symmetry and synchronism between the two cables and thus the members which are associated therewith. If from the theoretical point of view, this necessity seems legitimate, it is not so from the practical point of view. In fact, despite the care taken with a view to giving the cables the same physical parameters (in particular length, speed, tension, etc.), in practice these parameters may vary considerably from one cable to the other on the same cross section, if only owing to the fact that the paths of the cables are separate from each other (the paths possibly being varied overall) with all the resulting consequences. Under these conditions, maintaining the synchronism or symmetry of movement between the balance-beams or rollers may in fact prove to be a particularly troublesome drawback to the extent that it produces additional stresses in the apparatus for supporting cables.

SUMMARY OF THE INVENTION

The invention intends to remedy these drawbacks and to this end it proposes an apparatus for supporting cables of the type comprising, for each of the cables, one or more basic balance-beams provided with at least one roller with which the corresponding cable cooperates, this basic balance-beam being mounted to pivot about a point at right angles to the cables on support balance-beams themselves carried by a supporting structure, the basic balance-beams, rollers, support balance-beams for the various cables being placed in facing relationship, characterised by the fact that the corresponding basic balance-beams associated with the various cables are not connected mechanically to each other with a view to forming a one-piece arrangement such that their symmetrical pivoting is imposed.

According to another feature of the invention, the apparatus comprises means limiting the pivoting amplitude of the basic balance-beams about their pivot axis as well as means limiting the pivoting amplitude of the support balance-beams about their pivot axis.

Consequently, the invention intends to prevent completely fastening the rollers associated with the various cables to each other. These rollers have a certain freedom in their general movements. However, this reciprocal clearance is limited. Henceforth, the stresses on the cables or their support devices are better distributed.

BRIEF DESCRIPTION OF THE DRAWING

The invention will be better understood by virtue of the ensuing description referring to the accompanying drawings in which.

DESCRIPTION OF THE PREFERRED EMBODIMENT

Figures 1, 2, 3, 4:
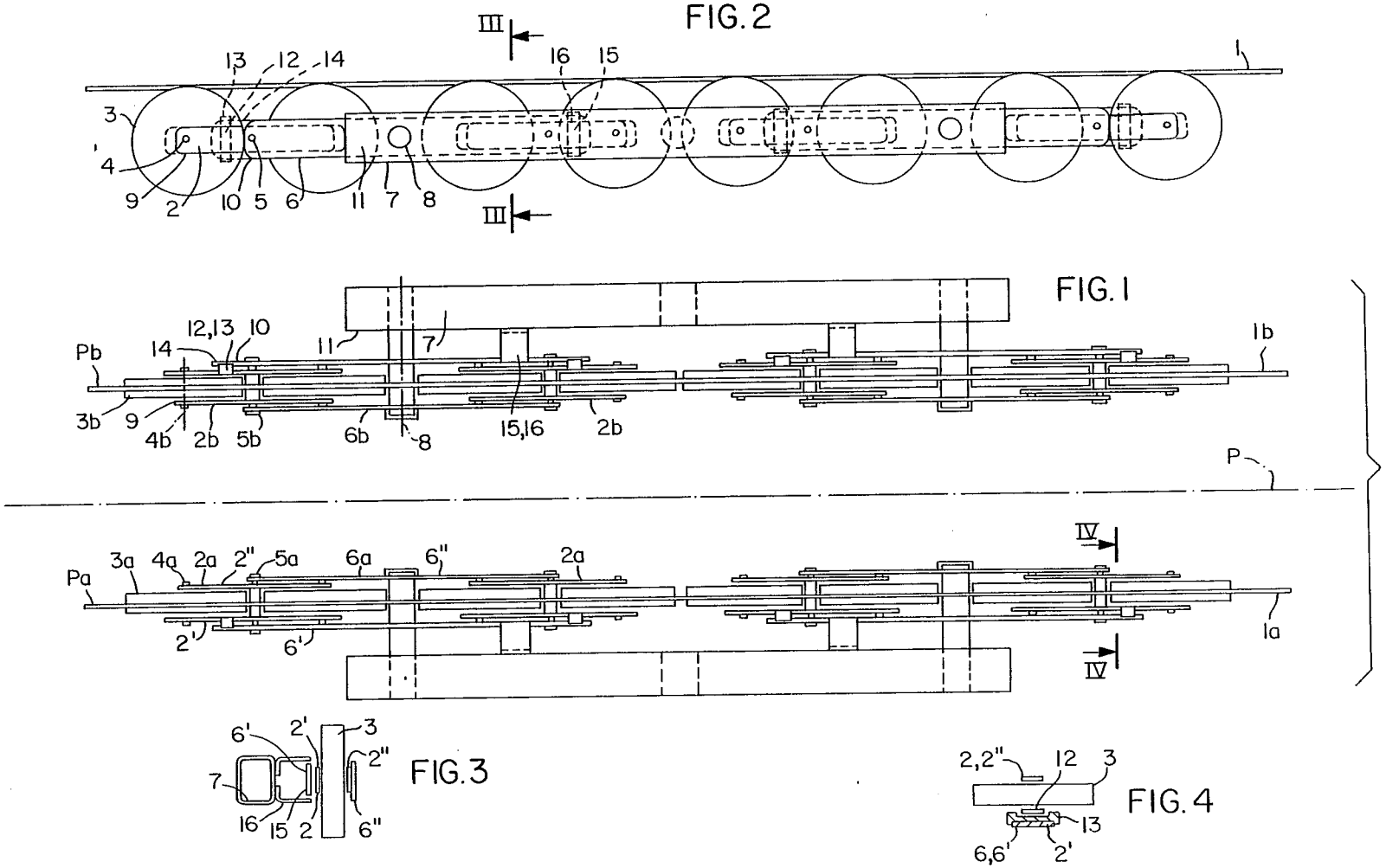
FIG. 1 is a plan view of an apparatus according to the invention.
FIG. 2 is an elevational view of the apparatus of FIG. 1.
FIG. 3 is a sectional view on line III—III of FIG. 2.
FIG. 4 is a sectional view on line IV—IV of FIG. 1.

The invention relates to an apparatus for supporting cables 1 intended in particular for a transportation installation comprising aerial cables, in particular two supporting and pulling cables which are parallel or substantially parallel 1*a*, 1*b*.

The apparatus has a general symmetry with respect to a median plane P. This plane being generally a vertical plane in the case of a conveying installation comprising aerial cables.

Throughout the following text, the apparatus will be described generally without referring specifically to one cable or another, the corresponding reference thus being devoid of any index. On the other hand, when it is necessary to refer expressly to a member corresponding to one of the cables 1*a* or 1*b*, the corresponding reference will be followed by the index a or b respectively.

Naturally the invention applies to the case of more than two cables.

For each of the cables 1, the apparatus comprises one or more generally several basic balance-beams 2 provided with at least one roller 3 pivoting about its pivot point 4 and with which the corresponding cable 1 cooperates. This basic balance-beam 2 is mounted to pivot about a point 5 at right angles to the cables 1 on support balance-beams 6 themselves carried by a supporting structure 7.

These basic balance-beams 2, rollers 3, pivot 4, pivot 5, support balance-beams 6 and components of the supporting structure 7 associated with the various cables 1, are placed in facing relationship since they are symmetrically with respect to the plane P.

In particular, the support balance-beam 6 is also mounted to pivot on the supporting structur 7 about a pivot 8 parallel to the pivots 4 and 5.

Preferably, a basic balance-beam 2 of a cable 1 comprises two rollers 3 located in the immediate vicinity of each other, the pivots 4 for these rollers being situated at the two end parts 9 of the basic balance-beam 2. Similarly, two basic balance-beams 2 are associated with a support balance-beam 6, the pivots 5 being situated at the end parts 10 of the support balance-beam 6. The two closest rollers 3 associated with the two basic balance-beams 2 are placed in the immediate vicinity of each other.

In the case illustrated in the drawings, two support balance-beams 6 are associated with the supporting structure 7 associated with a cable 1, the pivots 8 being located at the end parts 11 of this structure. In this case, the closest rollers of the two support balance-beams 6 are also located in the immediate vicinity of each other.

The pivots 5 and 8 are located in the central parts respectively if the basic balance-beam 2 and of the support balance-beam 6.

The rollers 3 are normally identical and constituted by grooved pulleys.

The invention relates to the case of a basic balance-beam 2 provided with a different number of rollers 3, to the case of a support balance-beam 6 provided with a different number of basic balance-beams 2 and to the case of a support structure 7 provided with a different number of support balance-beams 6. The invention also relates to the case where the structure which has been described (first balance-beam mounted to pivot by its central part at the end part of a second balance-beam) is multiplied in a more considerable manner.

The rollers 3 are either support rollers, when the cables 1 are located above, or compression rollers, when the cables 1 are located below.

In the example illustrated in the drawings, the support structure 7 is symmetrical with respect to the plane P and outside the path of the cables 1 and the rollers 3, basic balance-beams 2, the support balance-beams 6 are located laterally, therefore towards the outside of the support structure 7, or in the vicinity of or symmetrically on either side of the plane $P_A$ and $P_B$ parallel to the plane P and passing through the cables 1*a*, 1*b* respectively.

As a variation, the structur 7 is central (not shown).

Preferably each basic balance-beam 2 associated with a cable 1 is in two parts 2',2'' located respectively on either side of the rollers 3. Similarly, each balance-beam associated with a cable 1 is also in two parts 6', 6'' on either side of the rollers 3 and outside the parts 2' and 2'' of the basic balance-beams 2.

In the embodiment which is illustrated in the drawings, the support structure 7 forms two lateral beams fixed to and supported by a superstructure which is not shown, in particular forming part of a tower. Each pivot 8 is fixed and extends on either side of the support structure 7 in the direction of the plane Pa and Pb. Fixed to the pivot 8 are the two parts 6' and 6'' of a support balance-beam 10 and this is for each of the cables 1*a*, 1*b*. Two parts 6', 6'' are separated transversely one from the other to permit location between them of the parts 2' and 2'' of the two basic balance-beams 2 and of the rollers. According to the invention, the corresponding basic balance-beams 2 associated with the various cables (balance-beams 2*a* and 2*b*) are not connected mechanically to each other with a view to forming a one-piece arrangement such that their symmetrical pivoting is imposed. This absence of any direct and rigid mechanical connection is clearly shown in FIG. 1.

Similarly, according to the invention, the corresponding support balance-beams 6 associated with the various cables (i.e. the balance-beams 6*a* and 6*b*) are not connected mechanically to each other with a view to forming a one-piece arrangement such that their symmetrical pivoting is imposed. This feature is also clearly visible in FIG. 1.

According to one essential feature of the invention, means are provided limiting the pivoting amplitude of the basic balance-beams 2 about their pivot point 5. In particular, means are provided limiting the pivoting amplitude of the basic balance-beams 2 about their pivot point 5 to a value comprised between 0°, limits excluded, and 10°. These means limiting the pivoting amplitude of the basic balance-beams 2 about their pivot 5 are constituted for example by a central member 12 associated with/or constituted by the basic balance-beam 2 or the support balance-beam 6 cooperating with a lateral double member 13 forming a fork associated with/or constituted by the support balance-beam 6 or the basic balance beam 2. Thus, in the embodiment illustrated in the drawings, (FIG. 4), the central member 12 is constituted by one of the parts—in particular the internal part—of the balance-beam 2 and the lateral double member 13 and constituted by a member attached to the support balance-beam 6. This arrangement of the central member 12 and lateral double member 13 is at a distance from the pivot 5 which is neither too considerable in order that the pivoting amplitude is sufficient, nor too small in order that this amplitude is not too great and this is with a limited clearance of the central member 12 in the lateral double member 13. In particular, the arrangement of the central member 12 and lateral double member 13 is located between the pivot 5 of the basic balance-beam 2 and the pivot 4 of one of the rollers 3 which it supports. For example, the arrangement of the central member 12 and lateral double member 13 is located approximately one third of the distance separating the pivot 5 from the pivot 4, from the pivot 4. The clearance between the central member 12 and the lateral double member 13 is for example of the order of several millimeters.

In order to eliminate any distortions and disparity in the application of the stresses, an arrangement of the member 12 and member 13 is provided for each basic balance-beam 2.

As mentioned previously, this arrangement of the central member 12 and lateral double member 13 is located on the internal part of a balance-beam 2, i.e. the part directed towards the support structure 7, also, preferably, each arrangement of the central member 12 and lateral double member 13 is located at the extended end part 14 of the inner part 6' of the support balance-beam 6.

Also, according to one of the essential features of the invention, means are provided limiting the pivoting amplitude of the support balance-beams 6 about their pivot point 8. These means limit the pivoting for example to a value comprised between 0°, limited excluded and 10°. These means are constituted in particular by a central member 15 associated with/or constituted by the support balance-beam 6 or the support structure 7 cooperating with a lateral double member 16 forming a fork associated with/or constituted by the support structure 7 or the support balance-beam 6.

In the embodiment illustrated in the drawings (FIG. 3), the central member 15 is constituted by the support balance-beam 6. In particular its inner part 6' and the lateral double member 16 is constituted by a part attached to the side face of the support structure 7.

As seen previously with regard to the arrangement of the central member 12 and the lateral double member 13, the arrangement of the central member 15 and lateral double member 16 is sufficiently remote without being too remote from the pivot point 8 of the support balance-beam 6. In particular, the arrangement of the central member 15 and lateral double member 15 is located in the vicinity of the in particular substantially symmetrical end of the support balance-beams 6 of the arrangement of the central member 12, lateral member 13 with respect to the pivot 5.

Naturally, the support balance-beams 6 are wedged axially on the pivot 8 whilst being free to rotate about this pivot (apart from the presence of the means for limiting the pivoting movement 15, 16).

Whether it is for the arrangement 12, 13 or for the arrangement 15, 16, it is clear that it is possible to envisage the following variations:

the presence of end of travel damping means such as resilient stops; resilient return means for return towards a central position such as elastically deformable blocks; means for regulating the amplitude either by sliding of the arrangements 12, 13, 15, 16 respectively along the support balance-beam 6 or along the support structure 7 or even by means of an adjustable stop.

The invention also relates to a transportation installation comprising aerial cables, in particular two parallel support and pulling cables extending between terminal stations and supported by one or more support devices such as that which has been described, the cables themselves supporting one or more vehicles.

I claim:

1. In an aerial transportation system including two generally parallel endless aerial carrier and traction cables, apparatus respectively associated with each of said cables for separately supporting each of the cables, said apparatus associated with each of said cables each comprising at least one basic balance beam, at least one roller rotatably mounted at one end of said at least one basic balance beam for engaging its associated cable, at least one support balance beam, means for pivotally mounting said basic balance beam at one end of said support balance beam for pivotal movement about a pivot axis extending at right angles to the cables, a support structure, and means for mounting said support balance beam on said support structure; the basic balance beams, rollers, and support balance beam associated with each cable being arranged on their respective support structures in facing relation to each other whereby the basic balance beams on the respective support structures located in facing relation to each other are mechanically independent of each other; and means for limiting the pivoting amplitude of said basic balance beams about their respective pivot axes whereby limited independent relative pivotal movement of said two basic balance beams in facing relationship is permitted between two predetermined extreme positions.

2. Apparatus according to claim 1, wherein said limiting means includes means for limiting the pivoting amplitude of the basic balance beams about their pivot axis to a value comprised between 0°, limit excluded, and 10°.

3. Apparatus according to claim 1 wherein said limiting means comprises cooperating means on said basic balance beam and said support balance beam for limiting pivotal movement of said basic balance beam relative to said support balance beam.

4. Apparatus according to claim 1 wherein said limiting means is located on an extended end of an inner part of said support balance beam.

5. In an aerial transportation system including two generally parallel endless aerial carrier and traction cables, apparatus respectively associated with each of said cables for separately supporting each of the cables, said apparatus associated with each of said cables, said apparatus associated with each of said cables each comprising at leat one basic balance beam, at least one roller rotatably mounted at one end of said at least one basic balance beam for engaging its associated cable, at least one support balance beam, means for pivotally mounting said basic balance beam at one end of said support beam for pivotal movement about a first pivot axis extending at right angles to the cables, a support structure and means for mounting said support balance beam on said support structure for pivotal movement about a second pivot axis extending at right angles to the cables; the basic balance beams, rollers, and support balance beams associated with each cable being arranged on their respective support structures in facing relation to each other, whereby the basic balance beams on the respective support structures located in facing relation to each other are mechanically independent of each other; and means for limiting the pivoting amplitude of the support balance beams about their pivot axes whereby limited independent relative pivotal mpovement of said two support balance beams in facing relationship is permitted between two predetermined extreme positions.

6. Apparatus according to claim 5 wherein said limiting means includes means for limiting the pivoting amplitude of the support balance beams about said second pivot axes to a value comprised between 0°, limit excluded, and 10°.

7. Apparatus according to claim 6 wherein said limiting means comprises cooperating means on said support balance beam and said support structure for limiting pivotal movement of said support balance beam relative to said support structure.

* * * * *

UNITED STATES PATENT AND TRADEMARK OFFICE

CERTIFICATE OF CORRECTION

PATENT NO. : 4,777,886

DATED : October 18, 1988

INVENTOR(S) : Serge Tarassoff

It is certified that error appears in the above-identified patent and that said Letters Patent is hereby corrected as shown below:

Claim 5, column 6, line 24, delete "said apparatus associated with each of said cables".

Claim 5, column 6, line 45, delete "mpove-" and replace it with -- move- --.

Signed and Sealed this

Fourth Day of April, 1989

*Attest:*

*Attesting Officer*

DONALD J. QUIGG

*Commissioner of Patents and Trademarks*